US008743107B2

(12) United States Patent
Kim

(10) Patent No.: US 8,743,107 B2
(45) Date of Patent: Jun. 3, 2014

(54) LIQUID CRYSTAL DISPLAY DEVICE CAPABLE OF IMPROVING CHARGING RATE TO PIXELS

(75) Inventor: Min-Kyu Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 301 days.

(21) Appl. No.: 12/942,622

(22) Filed: Nov. 9, 2010

(65) Prior Publication Data

US 2011/0148852 A1 Jun. 23, 2011

(30) Foreign Application Priority Data

Dec. 18, 2009 (KR) ..... 10-2009-0126780

(51) Int. Cl.
*G09G 3/36* (2006.01)
*G09G 3/20* (2006.01)

(52) U.S. Cl.
CPC ..... *G09G 3/20* (2013.01); *G09G 2320/0252* (2013.01); *G09G 2320/0223* (2013.01); *G09G 2310/027* (2013.01); *G09G 2370/08* (2013.01)
USPC ..... 345/213; 345/87; 345/88; 345/204; 345/211

(58) Field of Classification Search
CPC ..... G09G 3/3611; G09G 3/3685
USPC ..... 345/87–100, 204, 211–213
See application file for complete search history.

(56) References Cited

U.S. PATENT DOCUMENTS 5,739,887 A 4/1998 Ueda et al.
5,986,648 A * 11/1999 Okada et al. ..... 345/204
2002/0075219 A1 6/2002 Morita
2002/0084965 A1 * 7/2002 Park ..... 345/87
2003/0038770 A1 2/2003 Lee et al.
2003/0137481 A1 7/2003 Nishida
2005/0206598 A1 9/2005 Yamazaki et al.
2006/0012550 A1 1/2006 Wang et al.

(Continued)

FOREIGN PATENT DOCUMENTS

CN 1363921 8/2002
CN 1432992 A 7/2003

(Continued)

OTHER PUBLICATIONS

Office Action issued in corresponding Chinese Patent Application No. 201010219224.3, mailed Jun. 19, 2012.

(Continued)

*Primary Examiner* — Srilakshmi K Kumar
*Assistant Examiner* — James Nokham
(74) *Attorney, Agent, or Firm* — Brinks Gilson & Lione

(57) ABSTRACT

The disclosed liquid crystal display device includes a display panel for displaying a picture thereon, a plurality of gate drive ICs for forwarding scan pulses for driving gate lines on the display panel, a plurality of upper data drive ICs for supplying pixel voltages to data lines on one side of the display panel respectively, a plurality of lower data drive ICs for supplying the pixel voltages to the data lines on the other side of the display panel respectively, a first timing controller for generating and supplying an upper data control signal to the upper data drive ICs for controlling operation of the upper data drive ICs, and a second timing controller for generating and supplying a lower data control signal to the lower data drive ICs for controlling operation of the lower data drive ICs.

7 Claims, 3 Drawing Sheets

(56) References Cited

U.S. PATENT DOCUMENTS

| | | | | |
|---|---|---|---|---|
| 2006/0022968 | A1* | 2/2006 | Kondo et al. | 345/211 |
| 2006/0055645 | A1* | 3/2006 | Kim | 345/87 |
| 2007/0103416 | A1* | 5/2007 | Kim | 345/88 |

FOREIGN PATENT DOCUMENTS

| | | | |
|---|---|---|---|
| CN | 1734539 | | 2/2006 |
| CN | 1991458 | A | 7/2007 |
| CN | 101226290 | A | 7/2008 |
| CN | 101281337 | A | 10/2008 |
| KR | 1020060012801 | | 2/2006 |
| TW | 200501041 | | 1/2005 |
| TW | 200836149 | A | 9/2008 |

OTHER PUBLICATIONS

Office Action issued in corresponding Chinese Patent Application No. 201010219224.3, mailed Feb. 21, 2013.

Office Action issued in corresponding Taiwan Patent Application No. 099119137, mailed Jul. 10, 2013, 20 pages.

Office Action issued in corresponding Korean Patent Application No. 10-2009-0126780, mailed Apr. 16, 2013.

Search Report issued in corresponding French Patent Application No. 1055195, mailed Jan. 22, 2013.

* cited by examiner

LIQUID CRYSTAL DISPLAY DEVICE CAPABLE OF IMPROVING CHARGING RATE TO PIXELS

This application claims the benefit of the Patent Korean Application No. 10-2009-0126780, filed on Dec. 18, 2009, which is hereby incorporated by reference as if fully set forth herein.

BACKGROUND

1. Field of the Invention

The present disclosure relates to liquid crystal display devices, and more particularly, to a liquid crystal display device which can improve a charge rate to pixels.

2. Discussion of the Related Art

As the liquid crystal display device becomes larger, lengths of gate lines and data lines of the liquid crystal display device increase relatively. As the length of the data line becomes the longer, increasing resistance and capacitance of the data line to make a portion of the data line far from an output terminal of a data driver to receive a pixel voltage with relatively great distortion compared to other portion, the charge rate of the pixel connected to the data line portion can not, but become poor, thereby making a picture quality poor.

BRIEF SUMMARY

A liquid crystal display device includes a display panel that displays a picture thereon, a plurality of gate drive ICs that forward scan pulses for driving gate lines on the display panel, a plurality of upper data drive ICs that supply pixel voltages to data lines on one side of the display panel respectively, a plurality of lower data drive ICs that supply the pixel voltages to the data lines on the other side of the display panel respectively, a first timing controller that generates and supplies an upper data control signal to the upper data drive ICs for controlling operation of the upper data drive ICs, and a second timing controller that generates and supplies a lower data control signal to the lower data drive ICs for controlling operation of the lower data drive ICs.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE DRAWINGS AND THE PRESENTLY PREFERRED EMBODIMENTS

Reference will now be made in detail to the specific embodiments of the present disclosure, examples of which are illustrated in the accompanying drawings. Wherever possible, the same reference numbers will be used throughout the drawings to refer to the same or like parts.

Figure 1:
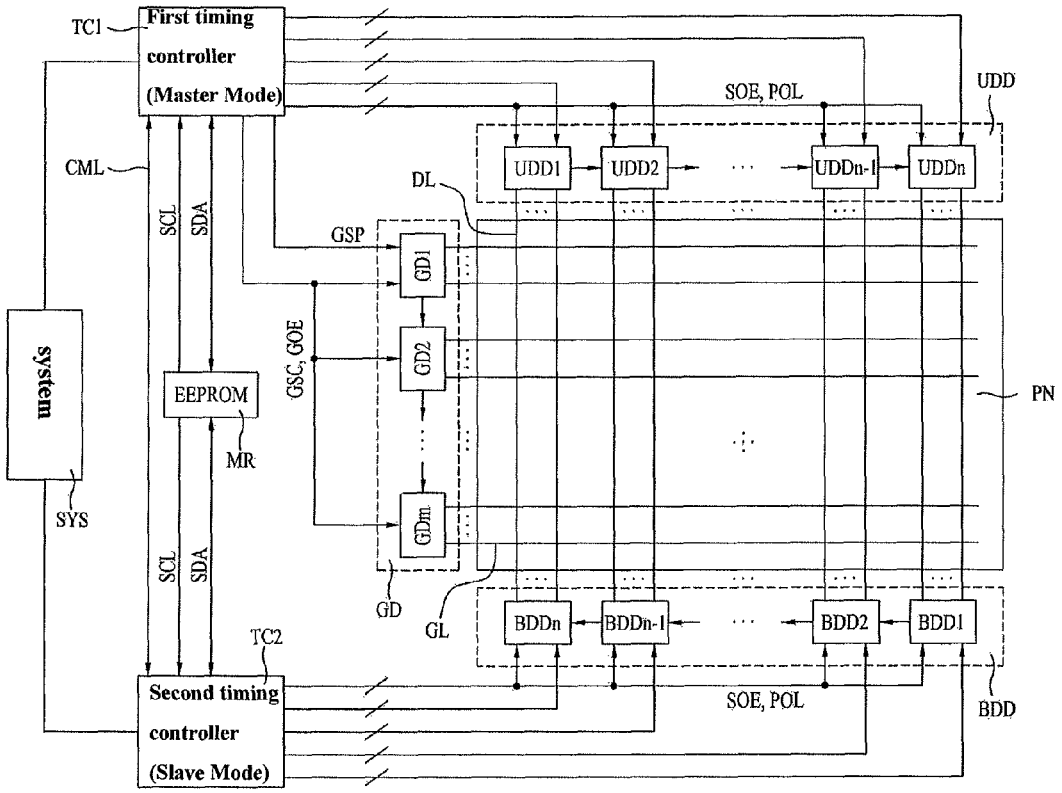
FIG. 1 illustrates a circuit diagram of a liquid crystal display device in accordance with a preferred embodiment of the present disclosure.

FIG. 1 illustrates a circuit diagram of a liquid crystal display device in accordance with a preferred embodiment of the present disclosure.

Referring to FIG. 1, the liquid crystal display device includes a display panel PN having a plurality of pixels defined by a plurality of gate lines GL and a plurality of data line DL crossing each other, a plurality of gate drive ICs GD1~GDm for forwarding scan pulses in succession for driving the gate lines GL, a plurality of upper data drive ICs UDD1~UDDn for supplying pixel voltages to the data lines on one side of the display panel PN respectively, a plurality of lower data drive ICs BDD1~BDDn for supplying pixel voltages to the data lines on the other side of the display panel PN respectively, a first timing controller TC1 for generating and supplying an upper data control signal to the upper data drive ICs UDD1~UDDn for controlling operation of the upper data drive ICs UDD1~UDDn, and a second timing controller TC2 for generating and supplying a lower data control signal to the lower data drive ICs $BDD_1$-$BDD_n$ for controlling operation of the lower data drive ICs $BDD_1$-$BDD_n$.

Figure 2:
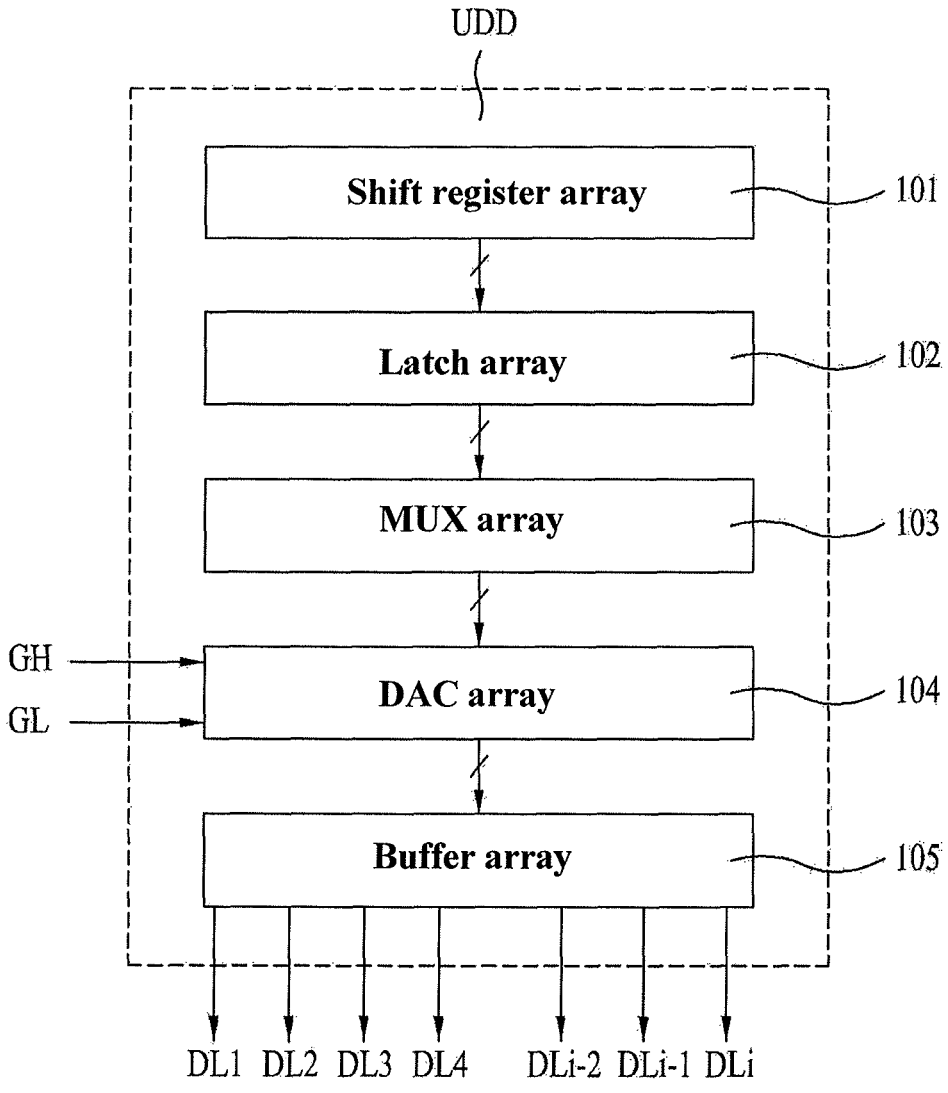
FIG. 2 illustrates a block diagram of an upper data driver having the upper data drive ICs in FIG. 1, in detail.

FIG. 2 illustrates a block diagram of an upper data driver DD having the upper data drive ICs UDD1~UDDn in FIG. 1, including a shift register array 101, a latch array 102, a MUX array, a digital/analog converter array (hereafter DAC array) and a buffer array.

The shift register array 101 shifts sequentially source start pulse from the first timing controller TC1 in response to source shift clock to generate sampling clocks.

The latch array 102 samples picture data from the first timing controller TC1 18 in response to the sampling clocks from the shift register array 101 and latches picture data of one line portion sampled thus. The latch array 102 also forwards the picture data of one line portions latched thus at a time in response to a source enable signal SOE from the first timing controller TC1 18.

The MUX array 103 forwards the picture data from the latch array 102 in horizontal period units as they are or shifts the picture data of one line portions from the latch array 102 to right side output lines by one line before forwarding the picture data. If the picture data from the latch array 102 are data in an odd horizontal period, the MUX array 103 forwards the picture data of one line portions from the latch array 102 as they are. Different from this, if the picture data from the latch array 102 are data in an even horizontal period, the MUX array 103 shifts the picture data of one line portions from the latch array 102 to right side output lines by one line before forwarding the picture data, respectively.

The DAC array 104 decodes the picture data from the MUX array 103 into analog values and selects a positive gamma compensation voltage GH or a negative gamma compensation voltage GL from the analog values decoded thus in response to a polarity control signal POL from the first timing controller TC1 18. That is, the DAC array 104 converts the digital data from the MUX array 103 into the positive gamma compensation voltage GH or the negative gamma compensation voltage GL and the digital data having output lines thereof shifted by the MUX array 103 into the positive gamma compensation voltage GH or the negative gamma compensation voltage GL.

The data having output lines shifted at every horizontal line and having polarities inverted by the MUX array 103 and the DAC array 104 are supplied to the data lines DL1~DLi by the buffer array 105.

In the meantime, the lower data driver DD having the lower data drive ICs BDD1~BDDn also has a configuration identical to the upper data driver UDD, except that the lower data driver DD is controlled by the second timing controller TC2 instead of the first timing controller TC1.

The gate driver GD having a plurality of gate drive ICs GD1~GDm supplies scan pulses to the gate lines GL in succession by using the gate start pulse GSP, the gate shift clock GSC and the gate output enable GOE from one of the first and second timing controllers TC1 and TC2.

The first timing controller TC1 18 re-arranges the picture data from a system SYS and supplies the picture data to the upper data drive ICs UDD1~UDDn matching to timings, and the upper data drive ICs UDD1~UDDn generate the pixel voltages based on the picture data from the first timing controller TC1. The first timing controller TC1 18 also generates upper data control signal and gate control signal by using horizontal synchronizing signal Hsync, vertical synchronizing signal Vsync and clock signals CLK from the systems SYS, respectively.

The upper data control signal includes a dot clock, a source start pulse, a source shift clock, a source enable and a polarity inverting signal POL. The gate control signal includes a gate start pulse GSP, a gate shift clock GSP, and a gate output enable GOE.

The second timing controller TC2 re-arranges the picture data from a system SYS and supplies the picture data to the lower data drive ICs BDD1~BDDn matching to timings, and the lower data drive ICs BDD1~BDDn generate the pixel voltages based on the picture data from the second timing controller TC2. The second timing controller TC2 also generates lower data control signal and gate control signal by using horizontal synchronizing signal Hsync, vertical synchronizing signal Vsync and clock signals CLK from the systems SYS, respectively.

The lower data control signal includes a dot clock, a source start pulse, a source shift clock, a source enable and a polarity inverting signal POL. The gate control signal includes a gate start pulse GSP, a gate shift clock GSP, and a gate output enable GOE.

The first timing controller TC1 supplies the picture data starting from the upper data drive IC positioned at one side edge of the display panel PN to the upper data drive IC positioned at the other side edge of the display panel PN in succession. Opposite to this, the second timing controller TC2 supplies the picture data starting from the lower data drive IC positioned at one side edge of the display panel PN to the lower data drive IC positioned at the other side edge of the display panel PN in succession. For an example, the first timing controller TC1 supplies the picture data starting from the first upper data drive IC to the nth upper data drive IC in succession, and the second timing controller TC2 supplies the picture data starting from the first lower data drive IC to the nth lower data drive IC in succession. In this instance, the first timing controller TC1 and the second timing controller TC2 forward the picture data in orders opposite to each other. That is, the first timing controller TC1 forwards the picture data starting the picture data of the first upper data drive IC to the picture data of the nth upper data drive IC in succession, and the second timing controller TC2 forwards the picture data starting from the picture data of the first lower data drive IC to the picture data of the nth lower data drive IC in succession. As an alternative to this, opposite to this, it can be made that the second timing controller TC2 forwards the picture data starting from the picture data of the nth lower data drive IC to the picture data of the first lower data drive IC in succession and the first timing controller TC1 forwards the picture data starting the picture data of the nth upper data drive IC to the picture data of the first upper data drive IC in succession.

Either of the first timing controller TC1 and the second timing controller TC2 is operative a master mode or a slave mode depending on an external mode control signal.

In detail, when driven in the master mode, the first timing controller TC1 generates and forwards a gate control signal to the gate drive ICs GD1~GDm for controlling operation of the gate drive ICs GD1~GDm in addition to the picture data and the upper data control signal. Opposite to this, when driven in the slave mode, the first timing controller TC1 forwards the picture data and the upper data control signal to the upper data drive ICs UDD1~UDDn.

Similarly, when driven in the master mode, the second timing controller TC2 generates and forwards a gate control signal to the gate drive ICs GD1~GDm for controlling operation of the gate drive ICs GD1~GDm in addition to the picture data and the lower data control signal. Opposite to this, when driven in the slave mode, the second timing controller TC2 forwards the picture data and the lower data control signal to the lower data drive ICs BDD1~BDDn.

In other words, when driven in the master mode, the first or second timing controller TC1 or TC2 forwards the picture data, the data control signal and the gate control signal. However, when driven in the slave mode, the first or second timing controller TC1 or TC2 forwards signals other than the gate control signal, i.e., the picture data and the data control signals.

In this instance, the first and second timing controller TC1 and TC2 are driven in modes opposite to each other. That is, when the first timing controller TC1 is driven in the master mode, the second timing controller TC2 is driven in the slave mode, and opposite to this, when the first timing controller TC1 is driven in the slave mode, the second timing controller TC2 is driven in the master mode.

Between the first timing controller TC1 and the second timing controller TC2, there is at least one communication line CML connected thereto. By making communication between the first timing controller TC1 and the second timing controller TC2, outputs of the first timing controller TC1 and the second timing controller TC2 can be synchronized.

That is, the timing controller in the master mode can control operation of a timing controller in the slave mode partially through the communication line CML. For an example, the timing controller in the master mode controls output timings for forwarding the pixel voltages thereof to the data lines DL as well as the output timings for forwarding the pixel voltages of the timing controller in the slave mode to the data lines DL through the communication line CML. To do this, the timing controller in the master mode controls the timing controller in the slave mode such that the two timing controllers supply the source output enables to the upper and lower data drive ICs UDD1~UDDn and BDD1~BDDn at the same time, respectively.

FIG. 1 illustrates an example in which the first timing controller TC1 is driven in the master mode and the second timing controller TC2 is driven in the slave mode. Opposite to this, the first timing controller TC1 may be driven in the slave mode and the second timing controller TC2 may be driven in the master mode.

The liquid crystal display device in accordance with a preferred embodiment of the present disclosure may include a memory MR having various correction data stored therein for correction of the picture data from the first and second timing controllers TC1 and TC2. In this instance, a first time period in which the timing controller in the master mode retrieves the correction data from the memory MR and a second time period in which the timing controller in the slave mode retrieves the correction data from the memory MR are different from each other.

The memory MR may be an EEPROM (Electrically Erasable Programmable Read-Only Memory).

Figure 3:
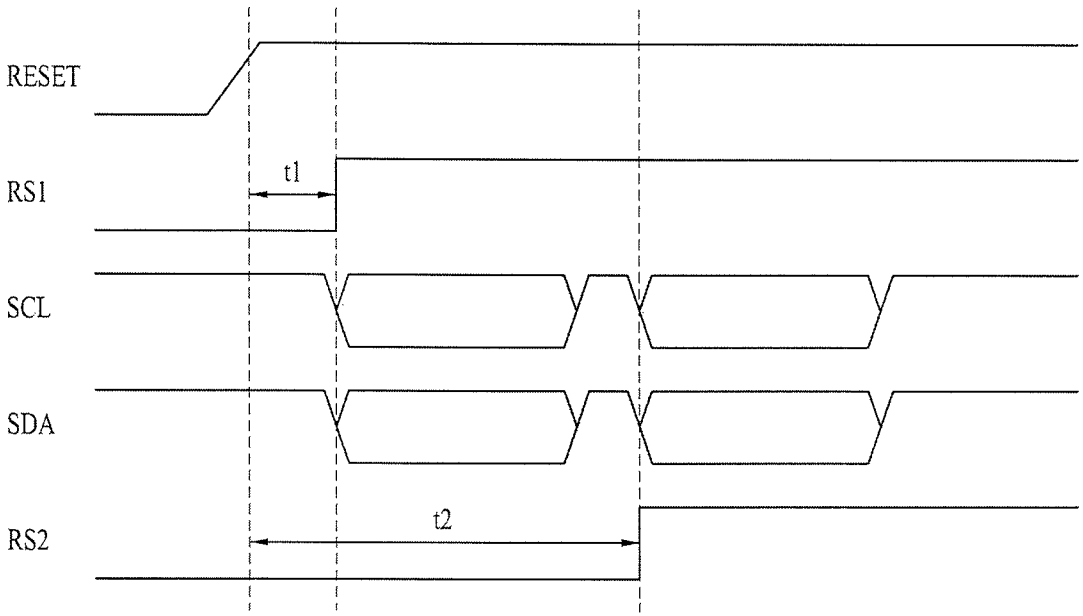
FIG. 3 illustrates a timing diagram of a read control signal being supplied to a timing controller.

FIG. 3 illustrates a timing diagram of a read control signal being supplied to the timing controller.

Referring to FIG. 3, when the timing controller is driven in the master mode, the timing controller retrieves the correction data from the memory MR after a t1 time period in response to a first read control signal RS1 which becomes active after the t1 time period. Opposite to this, when the same timing controller is driven in the slave mode, the timing controller retrieves the correction data from the memory MR after a t2 time period in response to a second read control signal RS2 which becomes active after the t2 time period. For an example, if the first timing controller TC1 is driven in the master mode and the second timing controller TC2 is driven in the slave mode, the first timing controller TC1 communicates with the memory MR in $I^2C$ communication system during the read time period after the t1 time period in response to the first read control signal RS1 supplied from an outside. Opposite to this, the second timing controller TC2 communicates with the memory MR in the $I^2C$ communication system during the read time period after the t2 time period in response to the second read control signal RS2 supplied from an outside. In this instance, the read time period of the first timing controller TC1 and the read time period of the second timing controller TC2 do not overlap. An SCL denotes a source clock signal, and an SDA denotes a source data signal. The first and second timing controllers TC1 and TC2 retrieve the source data signal of the correction data from the memory MR, respectively.

Or, the timing controller in the master mode controls a read time period in which the same timing controller reads the correction data from the memory MR, as well as controls the read time period of the timing controller in the slave mode through the communication line CML.

In the meantime, a 'reset' in FIG. 3 denotes a reset signal. At a moment logic of the reset signal reset turns from low to high, the first and second timing controllers TC1 and TC2 become ready to read the memory MR.

As has been described, the liquid crystal display device of the present disclosure has the following advantages.

First, the supply of the pixel voltages to opposite sides of the data lines permits to improve a charge rate to the data lines and the pixels connected thereto.

Second, the driving of the first timing controller and the second timing controller in one of the master mode and the slave mode permits to drive the upper drive ICs and the lower drive ICs, smoothly.

Third, the first timing controller and the second timing controller can synchronize output timings through the communication line.

Fourth, the setting of the retrieve time periods of the first timing controller and the second timing controller different from each other permits the two timing controllers to retrieve required data by using only one memory.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The invention claimed is:

1. A liquid crystal display device capable of improving charging rate to pixels comprising:

a display panel that displays a picture thereon, wherein the display panel includes a plurality of gate lines and a plurality of data lines;

a plurality of gate drive ICs that forward scan pulses for driving the gate lines;

a plurality of upper data drive ICs that supply pixel voltages to each one side of the data lines and drive the data lines;

a plurality of lower data drive ICs that supply the pixel voltages to each the other side of the same data lines being driven by the plurality of the upper data drive ICs and drive the same data lines;

a first timing controller that generates and supplies an upper data control signal to the plurality of upper data drive ICs for controlling operation of the plurality of upper data drive ICs; and a second timing controller that generates and supplies a lower data control signal to the plurality of lower data drive ICs for controlling operation of the plurality of lower data drive ICs;

wherein there is at least one communication line connected between the first timing controller and the second timing controller, and outputs of the first timing controller and the second timing controller can be synchronized by making communication between the first timing controller and the second timing controller;

wherein the first timing controller receives and re-arranges picture data from a system and supplies the same to the upper data drive ICs, matching to timings;

wherein the plurality of upper data drive ICs generate the pixel voltages base on the picture data from the first timing controller;

wherein the second timing controller receives and re-arranges picture data from a system and supplies the same to the plurality of lower data drive ICs, matching to timings;

wherein the plurality of lower data drive ICs generate the pixel voltages base on the picture data from the second timing controller;

wherein the first timing controller supplies the picture data starting from the upper data drive IC positioned at one side edge of the display panel to the upper data drive IC positioned at the other side edge of the display panel in succession, and the second timing controller supplies the picture data starting from the lower data drive IC positioned at the other side edge of the display panel to the lower data drive IC positioned at the one side edge of the display panel in succession.

2. The liquid crystal display device as claimed in claim 1, wherein either of the first and second timing controllers is operative in a master mode or a slave mode depending on an external mode control signal, when the first timing controller is driven in the master mode, the first timing controller generates and forwards a gate signal to the plurality of gate drive ICs for controlling operation of the plurality of gate drive ICs in addition to the picture data and the upper data control signal, when the second timing controller is driven in the master mode, the second timing controller generates and forwards the gate signal to the plurality of gate drive ICs for controlling operation of the plurality of gate drive ICs in addition to the picture data and the lower data control signal, when the first timing controller is driven in the slave mode, the first timing controller forwards the picture data and the upper data control signal to the plurality of upper data drive ICs, and when the second timing controller is driven in the slave mode, the second timing controller forwards the picture data and the lower data control signal to the plurality of lower data drive ICs.

3. The liquid crystal display device as claimed in claim 2, wherein the first and second timing controllers are driven in different modes.

4. The liquid crystal display device as claimed in claim 3, further comprising at least one communication line connected between the first timing controller and the second timing controller, and the timing controller in the master mode controls operation of the timing controller in the slave mode through the communication line, partially.

5. The liquid crystal display device as claimed in claim 4, wherein the timing controller in the master mode controls output timings for forwarding the pixel voltages thereof to the data lines as well as the output timings for forwarding the pixel voltages of the timing controller in the slave mode to the data lines through the communication line.

6. The liquid crystal display device as claimed in claim 5, further comprising a memory having various correction data stored therein for correction of the picture data from the first and second timing controllers, wherein a first time period in which the timing controller in the master mode retrieves the correction data from the memory and a second time period in which the timing controller in the slave mode retrieves the correction data from the memory are different from each other, and the timing controller in the master mode controls the first time period and the second time period.

7. The liquid crystal display device as claimed in claim 3, further comprising a memory having various correction data stored therein for correction of the picture data from the first and second timing controllers, wherein a first time period in which the timing controller in the master mode retrieves the correction data from the memory and a second time period in which the timing controller in the slave mode retrieves the correction data from the memory are different from each other.

* * * * *